US010184769B2

(12) United States Patent
Muster et al.

(10) Patent No.: US 10,184,769 B2
(45) Date of Patent: Jan. 22, 2019

(54) DETONATOR SYSTEM FOR HAND GRENADES

(71) Applicant: RUAG AMMOTEC AG, Thun (CH)

(72) Inventors: Michael Muster, Schüpfen (CH); Markus Gfeller, Uttigen (CH); Werner Knubel, Lungern (CH)

(73) Assignee: RUAG AMMOTEC AG, Thun (CH)

( * ) Notice: Subject to any disclaimer, the term of this patent is extended or adjusted under 35 U.S.C. 154(b) by 0 days.

(21) Appl. No.: 15/534,963

(22) PCT Filed: Dec. 10, 2015

(86) PCT No.: PCT/EP2015/079190
§ 371 (c)(1),
(2) Date: Jun. 9, 2017

(87) PCT Pub. No.: WO2016/091988
PCT Pub. Date: Jun. 16, 2016

(65) Prior Publication Data

US 2017/0343330 A1 Nov. 30, 2017

(30) Foreign Application Priority Data

Dec. 10, 2014 (EP) ..... 14197199

(51) Int. Cl.
*F42C 9/10* (2006.01)
*F42C 14/02* (2006.01)
(Continued)

(52) U.S. Cl.
CPC ..... *F42C 9/10* (2013.01); *F42C 14/02* (2013.01); *F42C 15/184* (2013.01); *F42C 15/34* (2013.01)

(58) Field of Classification Search
CPC ..... F42C 9/10; F42C 14/02; F42C 15/184; F42C 15/34
(Continued)

(56) References Cited

U.S. PATENT DOCUMENTS 3,311,059 A 3/1967 Berger
3,823,669 A * 7/1974 Zacharin ..... F42C 14/02 102/221
(Continued)

FOREIGN PATENT DOCUMENTS

AT 310 041 B 9/1973
EP 0277110 A2 8/1988
(Continued)

OTHER PUBLICATIONS

International Search Report for PCT/EP2015/079190 dated Feb. 17, 2016; English translation submitted herewith (7 Pages).

*Primary Examiner* — Samir Abdosh
(74) *Attorney, Agent, or Firm* — Fitch, Even, Tabin & Flannery, LLP

(57) ABSTRACT

The invention relates to a detonator system for hand grenades, having an ignition element (1) which after initiation triggers a delay and safety device, which, with a time delay after the initiation, fires a detonator (7), which then ignites an ignition booster (8), wherein the delay and safety device includes a dual safety device of two independent parts. So that the hand grenade detonator system according to the invention includes a purely pyrotechnic detonator system instead of a pyrotechnic-mechanical system, it is suggested that the delay and safety device consists of two pyrotechnic ignition delay devices with different delay times—specifically a safety element (3) and a delay element (4)—wherein the delay time of the safety element (3) is shorter than the delay time of the delay element (4), and the safety element (3) includes a timing composition which, once it has burned
(Continued)

through, ignites a gas charge (9), the gas of which opens blocking elements (5), and the delay element (4) includes a firing charge, and the firing charge is only in operative connection with the detonator (7) after the opening of the blocking elements (5).

16 Claims, 9 Drawing Sheets

(51) Int. Cl.
*F42C 15/184* (2006.01)
*F42C 15/34* (2006.01)

(58) Field of Classification Search
USPC ..... 102/64, 228
See application file for complete search history.

(56) References Cited

U.S. PATENT DOCUMENTS

| | | | | |
|---|---|---|---|---|
| 3,823,670 | A * | 7/1974 | Zacharin | F42C 14/02 102/487 |
| 4,982,663 | A * | 1/1991 | Scheve | F42C 15/184 102/251 |
| 5,196,649 | A | 3/1993 | DiRubbio et al. | |
| 7,013,809 | B1 | 3/2006 | Munoz Bueno | |
| 2012/0272852 | A1 | 11/2012 | Sibum | |
| 2017/0343330 | A1 * | 11/2017 | Muster | F42C 9/10 |

FOREIGN PATENT DOCUMENTS

| | | |
|---|---|---|
| EP | 2 516 958 A1 | 10/2012 |
| EP | 2 516 958 B1 | 3/2014 |
| FR | 2 500 619 A1 | 8/1982 |
| FR | 2 500 620 A1 | 8/1982 |

* cited by examiner

DETONATOR SYSTEM FOR HAND GRENADES

CROSS-REFERENCE TO RELATED APPLICATIONS

This application is a U.S. national phase application filed under 35 U.S.C. § 371 of International Application No. PCT/EP2015/079190, filed Dec. 10, 2015, designating the United States, which claims priority from European Patent Application No. 14197199.4, filed Dec. 10, 2014, which are hereby incorporated herein by reference in their entirety for all purposes.

The invention relates to a detonator system for hand grenades, having an ignition element which triggers a delay and safety device after initiation, which, with a time delay after the initiation, fires a detonator, which then ignites an ignition booster. The detonator has a dual safety device of two independent parts.

Known detonator systems for hand grenades are ignited in various ways, whether mechanically by a mechanism similar to a clockwork mechanism, or pyrotechnically by an ignition delay device. Combinations are also possible. Commonly used detonators are produced by the Diehl and Rheinmetall companies. The Diehl company has a system which includes multiple levels of security. Heat is produced when the ignition delay device burns through. This melts a solder fuse after two seconds. This melt-through enables the detonator to move into the ignition position, and to trigger the explosion within 4 seconds.

EP 2 516 958 B1 describes this detonator system in detail. Simpler systems only consist of a conventional ignition delay device which directly triggers the detonator (see U.S. Pat. No. 5,196,649 A or EP 0277110 A2). Such systems are cheaper. Mechanical systems are possible in principle, but are relatively expensive to manufacture and problematic in terms of reliability over a wide temperature range. If a "mechanical" system is a dud, it may become a mine. The slightly older patent U.S. Pat. No. 3,311,059 A describes such an invention. Efforts have already been made to realize electronic ignition of hand grenades (U.S. Pat. No. 7,013,809 B1). Such systems, however, have not yet become commonplace, due to the lack of reliability and low market acceptance. The prior art can be described overall as follows: Mechanical systems are generally relatively complex, moderately safe, and expensive. Electronic systems suffer from a bad reputation due to lack of reliability/safety. As a result, the detonator is usually triggered pyrotechnically or pyrotechnically-mechanically.

Pyrotechnic-mechanical detonators are very safe, and constitute what is likely the current highest level of technology. However, the price is essentially too high compared with simpler solutions, which do not meet safety requirements.

Important challenges which may arise for HG detonator systems (hand grenade detonator systems) are as follows:

- reliability
- premature ignition
- price (an eminent factor)
- use in all environments
- dangerous goods classification
- mass explosion Previous well-secured pyrotechnic-mechanical ignition systems have, due to the fuse that is desoldered by the combustion of the delay element, an element which must perform two functions. The intention of the novel detonator system is to avoid this. A simple, safe, and clear operating principle is desired.

Any technical system—whether mechanical, electronic, pneumatic, thermodynamic, or, as in this case, pyrotechnic—can be equipped with a logical And switch. Of course, combinations of these operating principles are possible. These logical And circuits produce system security. However, they often increase the complexity and hence the price. The novel hand grenade detonator system according to the invention should include a purely pyrotechnic detonator system, instead of a pyrotechnic-mechanical system.

This object is achieved by a detonator system according to the features of claim 1.

Because the delay and safety device consists of two pyrotechnic ignition delay devices with different delay times—specifically a safety element and a delay element, wherein the delay time of the safety element is shorter than the delay time of the delay element, and the safety element includes a timing composition which, once it has burned out, ignites a gas charge, the gas of which opens blocking elements, and the delay element includes a firing charge, and the firing charge is only in operative connection with the detonator after the opening of the blocking elements, a dual-protection pyrotechnic-mechanical detonator system is created which has a simple, safe, cost-effective, and clear operating principle.

In a preferred embodiment, the timing composition and the gas charge of the safety element are arranged in a safety element chamber, and the timing composition, along with the firing charge, of the delay element is arranged in a delay element chamber, and both chambers open into a working chamber to which the detonator is connected, and a blocking element is arranged, as a valve-like structure—preferably a one-way valve, a flap valve or a bursting disk—in each case between the working chamber and the delay element chamber, and between the working chamber and the detonator, wherein the gas of the gas charge can open the blocking elements, but the firing charge and/or the pressure thereof cannot. The spatial separation of the safety element from the delay element—each in a separate chamber—has the advantage that the combustion rate and/or the delay time of both ignition delay devices can be set individually, and therefore the gas charge, ignited by the timing composition, can only actuate the valve-like structure in the working chamber. Only after this actuation are the blocking elements opened. As such, the firing charge has a functional connection with the detonator.

Preferably, the ignition element is a primer which can be initiated by a firing pin. Primers are safe, inexpensive, reliable and ready to use in all environments.

So that the ignition element can ignite the safety element and the delay element at the same time, the fire cone of the ignition element preferably leads into a cavity, and the cavity is connected to the safety element chamber and the delay element chamber, wherein a cone which directs the fire cone to the two timing compositions in the two chambers is arranged in the cavity before the two chambers.

The lower ends of the safety element and the delay element are each preferably equipped with a throttle cup which consists of a cone with individual, uniformly distributed bore holes; or the lower ends are equipped with a threaded screw. It can also be contemplated that the timing composition, the gas charge and the firing charge each contain an adhesive, so that the charges can be glued into the cavities of the ignition delay devices. The charges are held in their respective chambers in this way.

In a preferred embodiment, the blocking element is a bursting disk with predetermined breaking points on one side, or a two-part flap valve made of metal, which consists of two superposed disks. Such blocking elements are inexpensive, block in one direction, and allow opening in another direction without great pressure.

In a further embodiment of the invention, the detonator can slide in a detonator housing from a safety position into a firing position, and can be locked in both positions, wherein the gas generated by the gas charge slides the detonator out of its safety position and into its firing position. This further secures the detonator system by spatially separating the detonator in its safety position from the ignition booster so that it cannot ignite the same.

So that the detonator remains in its two positions, it preferably has a bead or a plurality of beads on its outer circumference, which latch(es) into corresponding recesses in the housing.

The detonator system can also be further secured by the detonator being able to slide in a detonator housing from a safety position into a firing position, and by a sliding piston being inserted into a bore hole, able to slide from a safety position into a firing position, wherein the piston supports the detonator via an elbow, and when the piston slides into its firing position, the detonator is likewise slid into its firing position.

In an embodiment with a further additional safeguard of the detonator system, a spring, a safety shutter, and a safety pin are arranged in the cavity, wherein the spring is supported on one side on the cone and on the other side on the safety shutter, and the safety shutter is supported on the safety pin, and when the safety pin is pulled, the spring slides the safety shutter toward the ignition element, and as a result, the ignition delay devices can be ignited. This means that only after the safety pin is pulled is it at all possible for the ignition delay devices to be ignited.

In a further safeguard arrangement, the ignition element is arranged in a cup which is only fixed via a lacquer in a capsule holder, such that if the ignition element is unintentionally ignited, a jacket blowout occurs which prevents ignition of the ignition delay devices.

The invention is further described below with reference to the figures, in which:

FIG. 1 shows a cross-section of a hand grenade, with a detonator system according to the invention;

FIG. 2*a* shows the detonator system at activation, FIG. 2*b* approx. 2 seconds after activation, and FIG. 2*c* approx. 4 seconds after activation;

FIGS. 3*a* and 3*b* show the principle of the detonator system according to the invention;

Figure 9B:
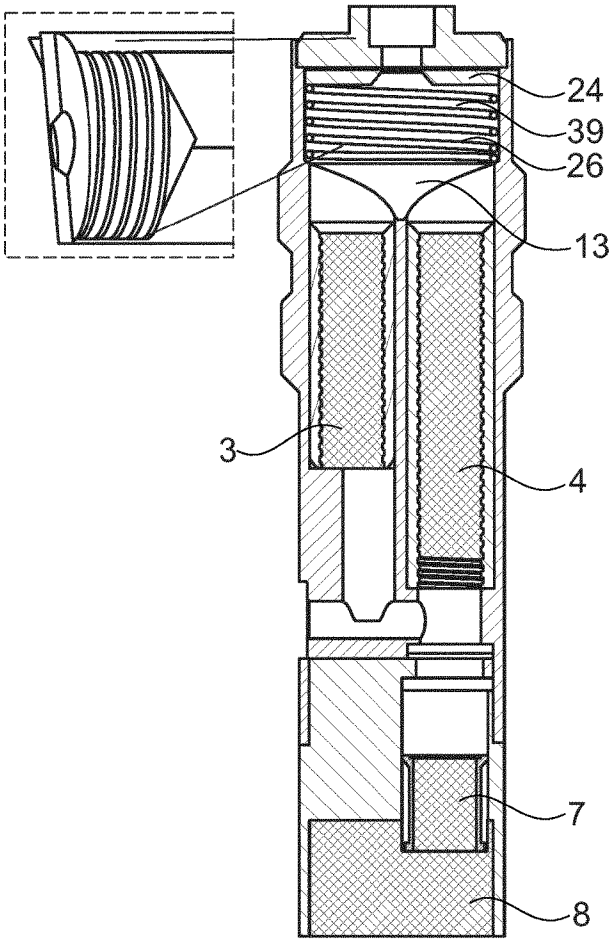
Figure 9A:
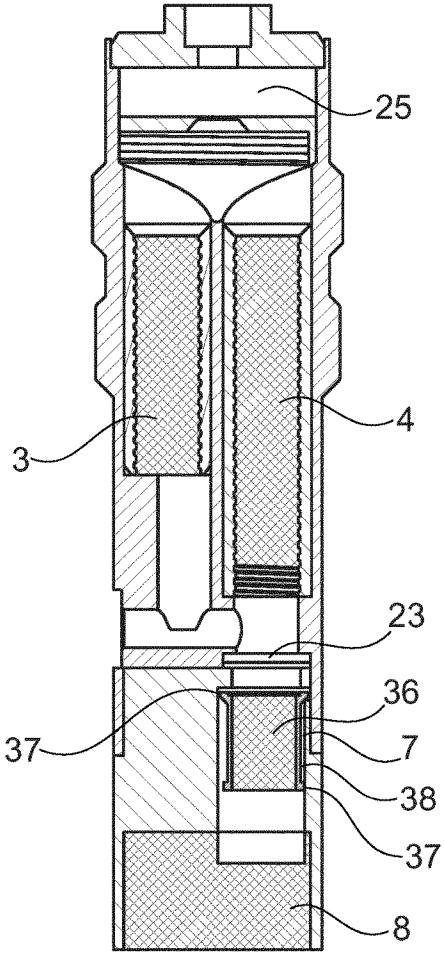
Figure 10B:
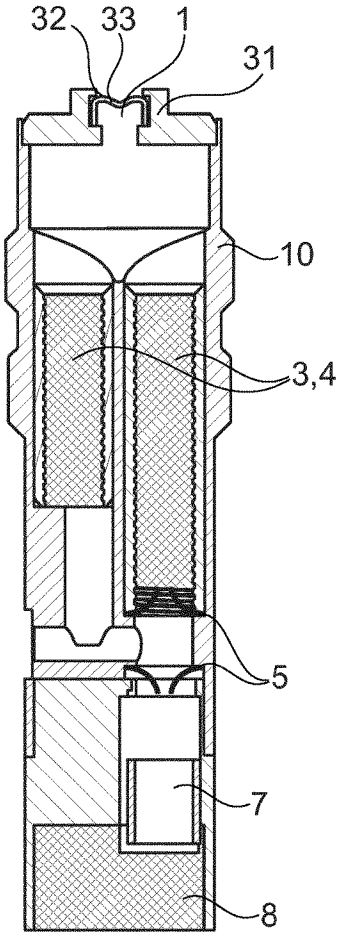
Figure 10A:
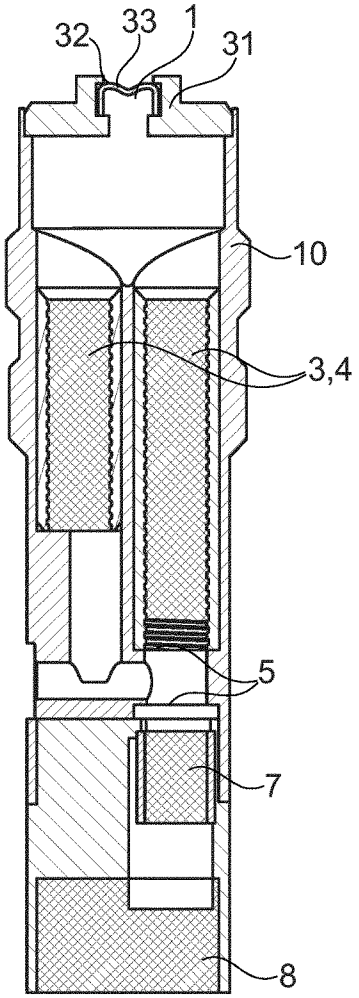

FIGS. 6*a* to 6*c* show different embodiments of the blocking elements, and FIG. 6*d* shows a section through the bursting disk and/or the one-way flap;

FIGS. 7*a* and 7*b* show the stress distribution when the pressure comes from different sides;

FIGS. 8*a* to 8*d* show the blocking element constructed as a two-part flap valve;

FIG. 9*a* shows the detonator in its safety position and FIG. 9*b* shows the detonator in its ignition position; and FIG. 10*a* shows a safeguard in the case of an unintended ignition of the ignition element and FIG. 10*b* shows the detonator according to FIG. 10*a*, in the ignition position.

Figure 1:
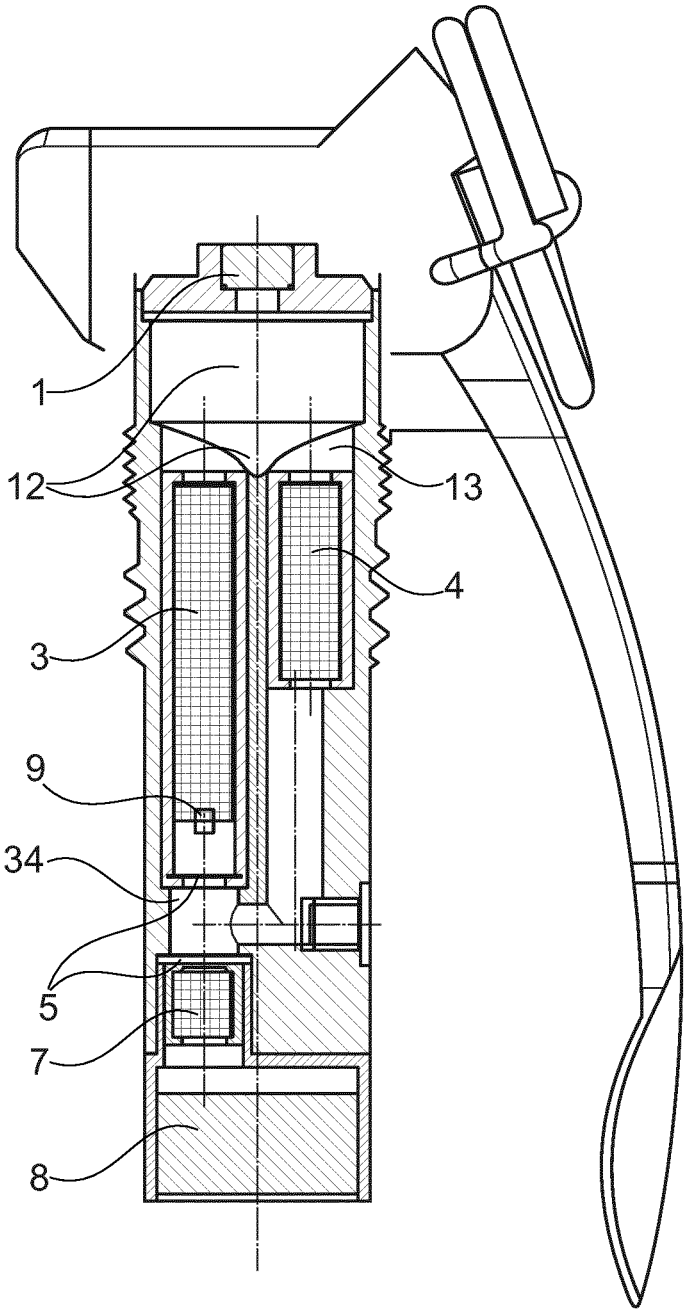

Description of the detonator system according to the invention (operating principle):

FIG. 1 shows a cross-section of a hand grenade, with a detonator system according to the invention. FIG. 2*a* shows the detonator system at activation, FIG. 2*b* approx. 2 seconds after activation, and FIG. 2*c* approx. 4 seconds after activation. Like numbers refer to the same object.

FIG. 1 shows a detonator system for hand grenades, having an ignition element 1 which triggers a delay and safety device after initiation, which fires a detonator 7 with a time delay after the initiation, which then fires an ignition booster 8, wherein the delay and safety device includes a dual safety device of two independent parts. Two pyrotechnic ignition delay devices with different delay times are used, specifically a safety element 3 and a delay element 4, wherein the delay of the safety element 3 is shorter than the delay of the delay element 4, and the safety element 3 includes a timing composition which, once it has burned through, ignites a gas charge 9, the gas of which opens blocking elements 5, and the delay element 4 includes a timing composition and firing charge, and the firing charge is only in operative connection with the detonator 7 after the opening of the blocking elements 5.

The timing composition and the gas charge 9 of the safety element 3 are arranged in a safety element chamber, and the timing composition and the firing charge of the delay element 4 are arranged in a delay element chamber. Both chambers open into a working chamber 34 with which the detonator 7 is connected. A blocking element is arranged, as a valve-like structure 5—preferably a one-way valve, a flap valve or a bursting disk—between the working chamber and the delay element chamber, and also between the working chamber and the detonator, wherein the gas of the gas charge 9 can open the blocking elements, but the firing charge and/or the pressure thereof cannot.

Figure 2:
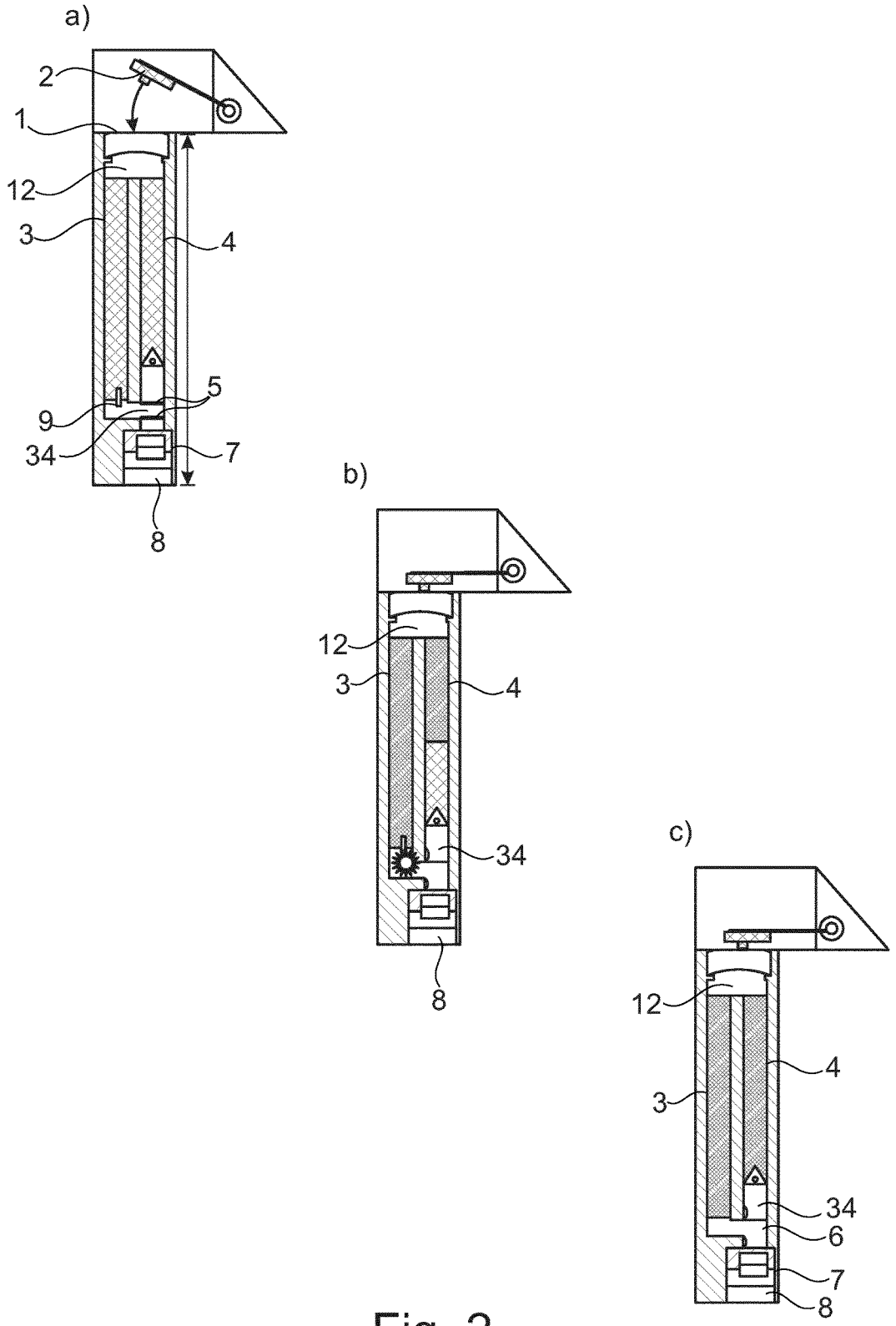

The ignition element 1 is a primer which can be initiated by a firing pin 2 (see FIG. 2).

The fire cone of the ignition element 1 leads into a cavity 12, and the cavity 12 is connected to the safety element chamber and the delay element chamber, wherein a cone 13 is arranged in the cavity 12 in front of the two chambers, and directs the fire cone into the two chambers and to the two ignition delay devices 3, 4.

Figure 6:
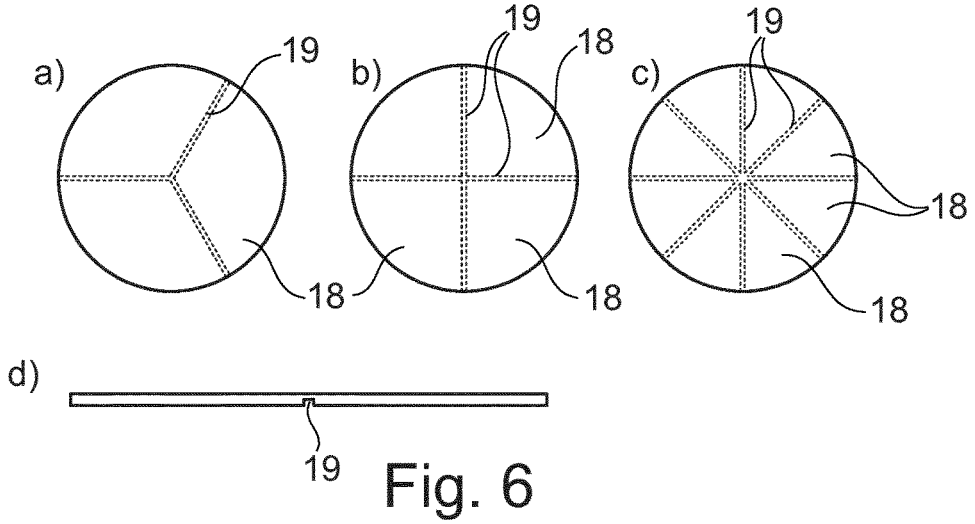
Figure 7:
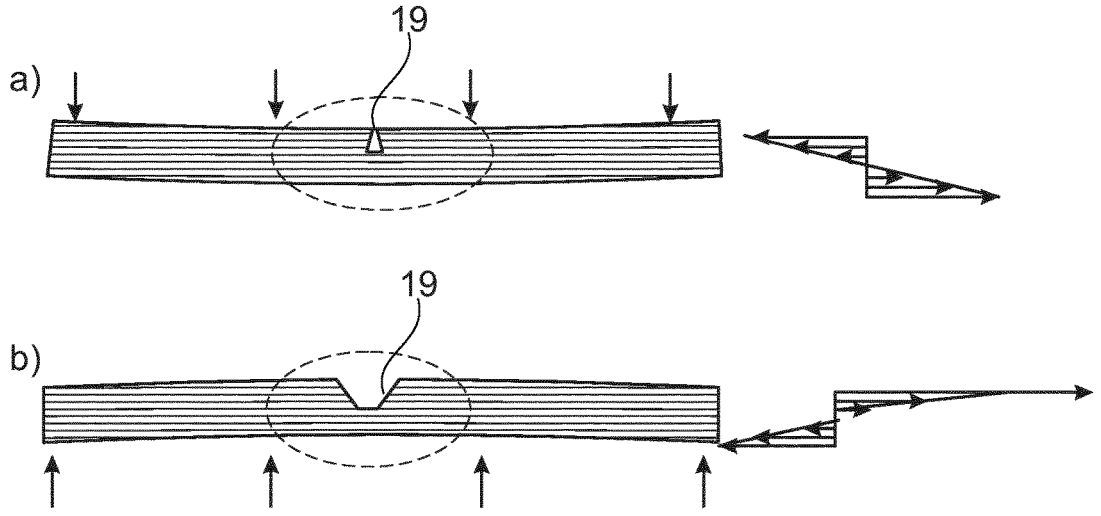
Figure 8:
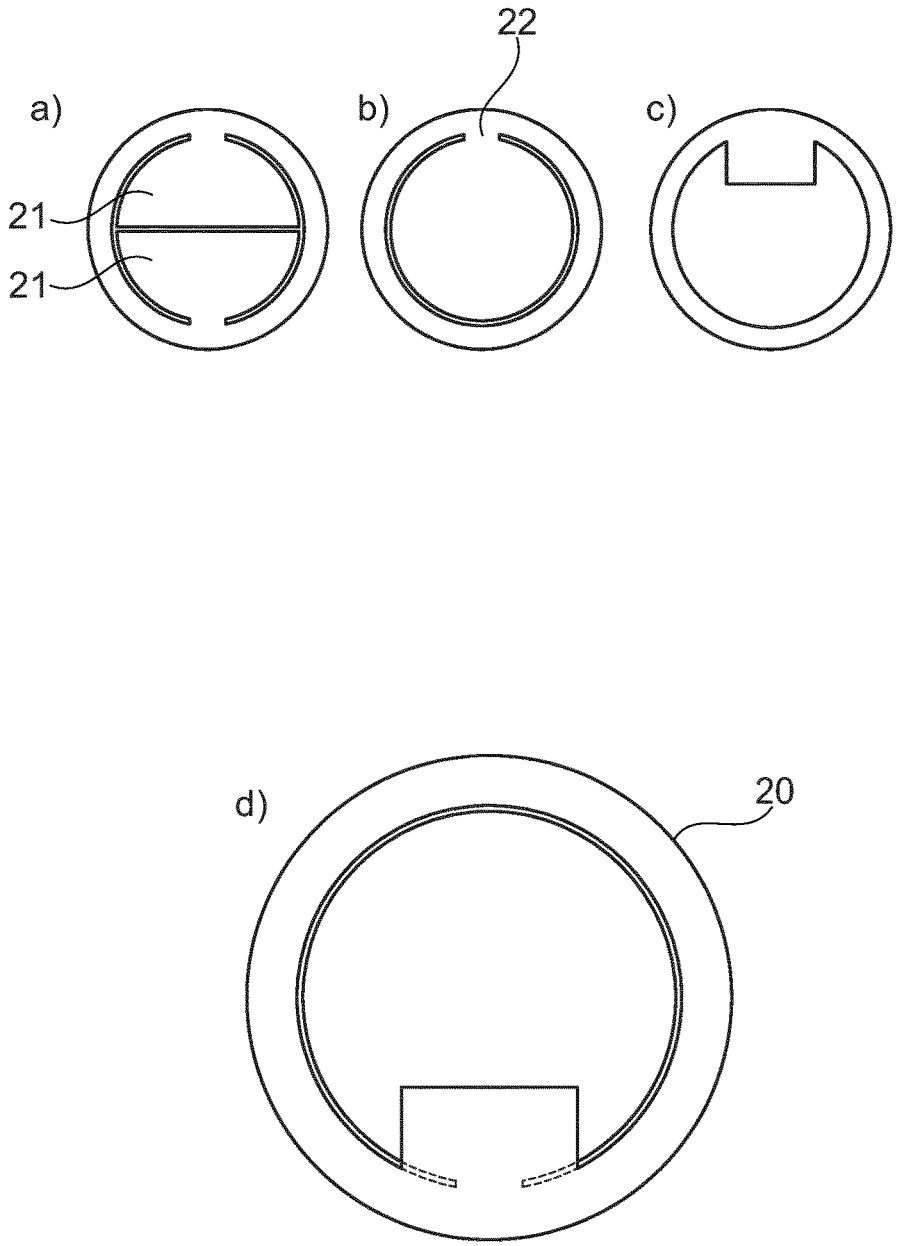

The blocking element 5 can be a bursting disk having predetermined breaking points on one side, or the blocking element 5 can be a two-part flap valve 20 made of metal, consisting of two superimposed disks (see FIGS. 6 to 8).

FIG. 2*a* shows the initiation process. The firing pin 2 is triggered and is accelerated in the direction of the ignition element 1 (known, for example, from EP 2 516 958 B1). As the ignition chain proceeds further, there is a dual ignition of two pyrotechnic ignition delay devices. A pyrotechnic ignition delay device, namely the safety element 3, requires approximately 2-3 seconds for the ignition gap. This safety element 3 then ignites a small gas charge 9 which has a functional connection to the end thereof ('gas charge' means a gas charge and/or pressure generator). This gas charge 9 generates a gas and therefore a pressure which opens two blocking devices 5. The delay element—also called an ignition delay device 4—can only act freely on the detonator 7, and therefore on the ignition booster 8, once the one-way valves 5 are opened. The explosion only occurs once this has happened.

FIG. 2*b* shows the process after approx. 2 seconds. The ignition element 1 has been initiated by the firing pin 2, and has therefore ignited both the safety element 3 and the delay element 4. The safety element 3 has, as shown in FIG. 2*b*, burned through, and has opened the one-way flaps functioning as the blocking elements 5. However, the delay element 4 has only partially burned through.

FIG. 2*c* shows the second step, after about 4 seconds. The delay element 4 has burned through, and has created a firing cone 6 which then activates the detonator 7, which then ignites the ignition booster 8.

An essential feature of the invention is that the blocking elements 5 are only opened by the safety element 3 which ignites the small gas charge 9. The delay element 4 and/or its pressure is sized such that it cannot open the blocking elements 5.

Construction

Figure 3A:
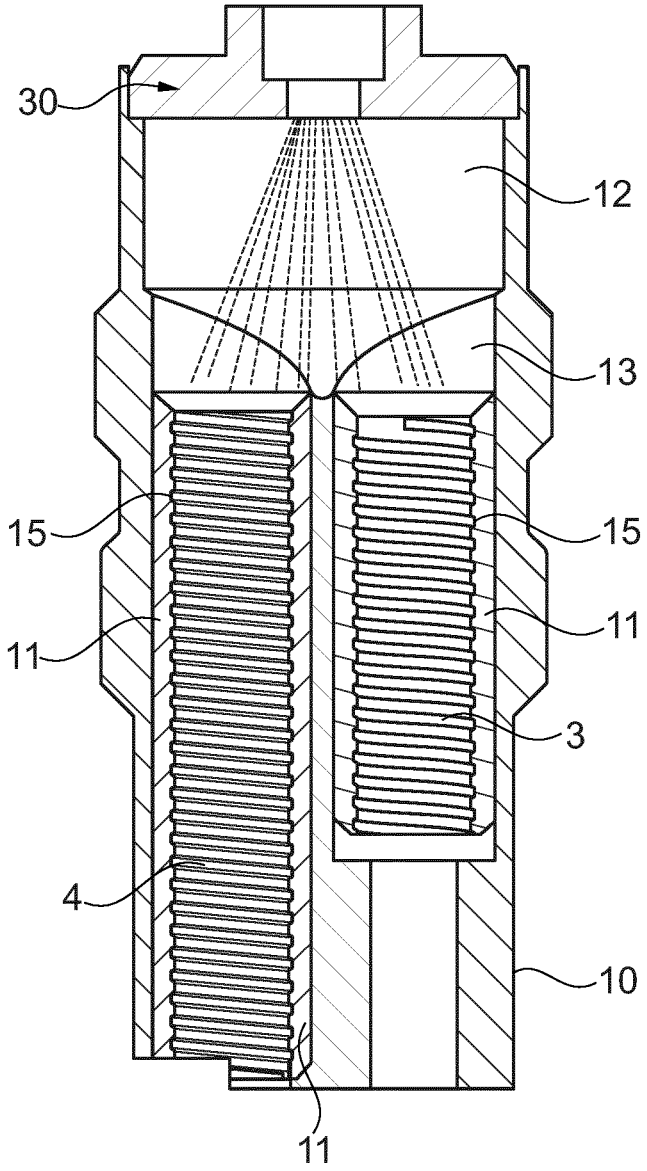
Figure 3B:
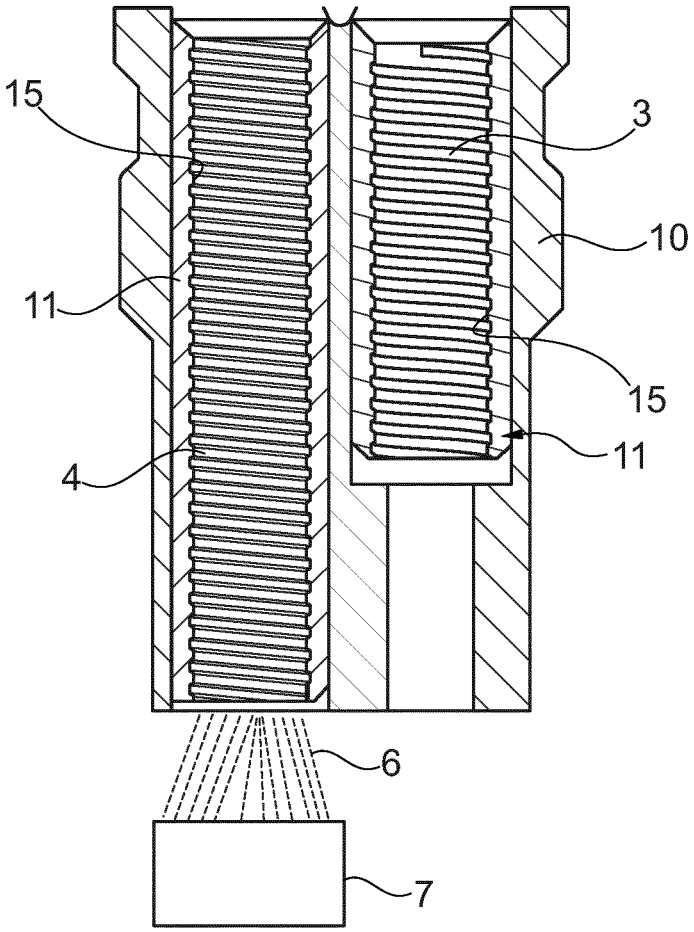

FIGS. 3*a* and 3*b* show the principle of the detonator system according to the invention. FIG. 3*a* shows the upper part and FIG. 3*b* shows the lower part of the detonator system, also called a detonator. The detonator preferably has a primary jacket 10 with two separate tube systems 11, each of which contains a separate ignition delay device, particularly the safety element 3 and the delay element 4. The primary jacket 10 is preferably equipped with two threadings. The upper is used for fixing the detonator head 30, with the firing pin 2. The lower threading fixes the hand grenade body.

This detonator system requires two pyrotechnic ignition delay devices, wherein the safety element 3 ultimately generates pressure, and the delay element 4 ultimately generates a jet of fire and/or a fire cone 6. The two ignition delay devices 3, 4 are preferably ignited via a common ignition element 1, for example a primer. The cavity 12 (see also FIG. 2) between the ignition element 1 and the ignition delay device is equipped with a cone 13 to direct the fire cone 6, starting from the ignition element 1, to the two ignition delay devices.

Figure 4:
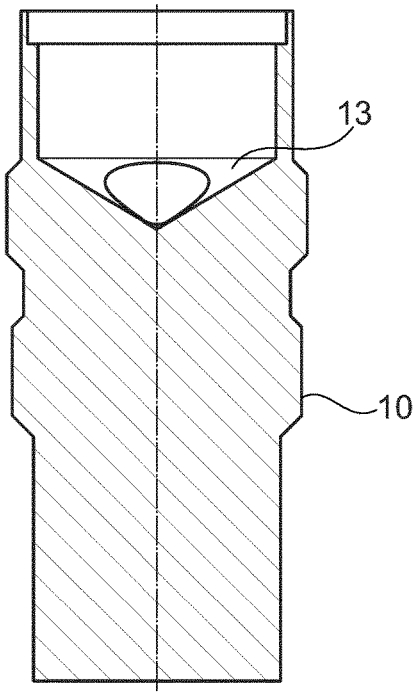
FIG. 4 shows the cone in a cross-section of the primary jacket.

FIG. 4 shows this cone 13 in a cross-section of the primary jacket 10.

The two ignition delay devices 3, 4 have different designs to achieve different delay times. The ignition delay devices can have different lengths and be filled with the same timing composition mixture, or different timing composition mixtures can be used, having the same charge length. The ignition delay devices are also designed to have different effects. The end of the safety element 3 which will initiate pressure is equipped with a gas charge 9—that is, with a pyrotechnic system with low sparking but rapid burning—preferably an explosive propellant. The end of the ignition delay device which will ultimately fire the detonator 7—that is, the delay element 4—is exposed to a charge, which, specifically, ejects fire (a firing charge). The addition of a metal such as zirconium, titanium, magnesium, nickel is preferred in this case.

Figure 5:
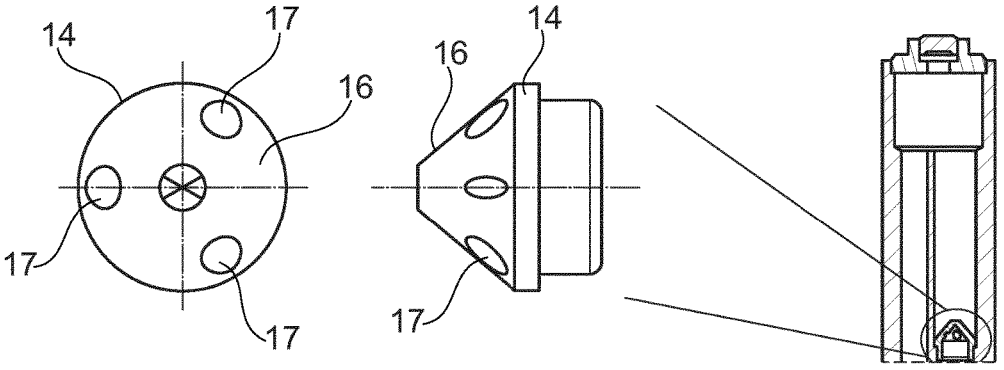
FIG. 5 shows the lower ends of the ignition delay devices can each be equipped with throttle cups.

The lower ends of the ignition delay devices can each be equipped with throttle cups 14 (see FIG. 5). The throttle cup 14 serves to concentrate the jet of fire and to hold the charge. The throttle cup 14 consists, in a preferred embodiment, of a cone 16 with individual, evenly distributed bore holes 17. The throttle cup 14 has a diameter which is slightly smaller than the tube system 11. To fix the ignition delay device in place, instead of a throttle cup 14, it is possible to use just one threaded screw 15 into which are incorporated the pipe system or the ignition delay devices (see FIGS. 3*a*, 3*b*).

The opening mechanism and/or the one-way valves and/or the blocking elements 5 are a critical assembly. FIGS. 6*a* to 6*c* show different embodiments of the blocking elements 5. The safety element 3, which generates the pressure, is responsible for the opening of the blocking elements 5, functioning as valve-like structures. The blocking elements 5 are preferably a thin bursting disk or a one-way valve. In this case, it is required that the safety element 3 can open the blocking elements, but the delay element 4 is not able to open the blocking elements. The bursting disks and/or the one-way flaps of the blocking elements 5 are preferably constructed of a single piece which has three to eight segments 18. FIG. 6*a* shows a bursting disk and/or the one-way flap of the blocking device 5, with three segments 18. FIG. 6*b* has 4 segments, and FIG. 6*c* has 6 segments. FIG. 6*d* shows a section through the bursting disk and/or the one-way flap. The grooves 19 represent the predetermined breaking points; see FIG. 6*d*. In the direction of the structured surface, the bursting disk is only able, due to the resulting stress concentration, to oppose a significantly lower pressure (see FIG. 7). FIG. 7*a* shows the stress distribution when the pressure comes from the side on which predetermined breaking points 19 are arranged. FIG. 7*b* shows the stress distribution when the pressure comes from the opposite side, on which there are no predetermined breaking points 19.

In another case, the blocking element 5 can also be constructed as a two-part flap valve 20 (FIGS. 8*a* to 8*d*). This flap valve 20 has two superposed disks made of a metal. The flap mechanism only functions in one direction, due to a retaining arm 22. The effect in this case is the same as that of the bursting disk; however, a considerably smaller amount of force is needed to open this type of valve. The flap mechanism can be realized with a single-part or multi-part flap. FIG. 8*a* shows a double-leaf flap valve 20 with two flaps 21. FIGS. 8*b* and 8*c* show two disks of a flap valve 20 according to the invention; these are superimposed as shown in FIG. 8*d*. The different ignition delay devices, in connection with the opening mechanism, enable the realization of a detonator system which satisfies safety standards. If a delay system is not working properly, detonation does not occur.

Further Development, Detonator Safety

Another level of safety can be realized by the detonator 7 remaining in the original position remote from the ignition booster 8. When the opening mechanism—for example, the one-way valve 5—is activated, the residual pressure fixes the detonator 7 to the ignition booster 8 with a closure, thereby moving it into the ignition position. The closure should preferably be designed as a snap closure. Bayonet closures and frictional fasteners can also be contemplated.

FIG. 9*a* shows the detonator in its safety position—i.e., the unarmed starting position. The detonator 7 is arranged spaced apart from the ignition booster 8. FIG. 9*b* shows the detonator in its ignition position. The gas generated by the safety element 3 has opened the bursting disk 23, and has pushed the detonator 7 from its safety position into the firing position. In the safety position, the safety shutter 24 covers the parallel ignition delay device. If the safety pin 25 is pulled due to the triggering of the firing pin, the safety shutter 24 biased by the spring 26 can shoot up, thereby making possible the ignition of both ignition delay devices. The safety on the detonator is implemented by a simple click system, for example. When the bursting disk 23 opens, the detonator 7 is also pushed by the pressure into the ignition position—i.e. the armed position. The detonator 7 need only be modified slightly for this purpose.

FIG. 10*a* shows a safeguard in the case of an unintended ignition of the ignition element. The ignition element 1 is positioned in a cup 33 which is only fixed in the detonator and/or in the capsule holder 31 via a lacquer. Therefore, in the safety position, the ignition element 1 is only secured with a lacquer, which is also called a ring joint lacquer 32.

The cup 33 is not fixed in the capsule holder 31 with a press fit. As a result, a jacket blowout occurs if the ignition element 1 is ignited in the safety position. The ignition delay devices 3, 4 are therefore not ignited.

FIG. 10*b* shows the detonator according to FIG. 10*a*, in the ignition position. The pressure initiated by the safety element 3 has opened the bursting disks and/or blocking elements 5, and brought the detonator 7 into the firing position in which it rests against the ignition booster 8.

The invention claimed is:

1. A detonator system for hand grenades, having an ignition element which after initiation triggers a delay and safety device which, with a delay after the initiation, fires a detonator, which subsequently fires an ignition booster, wherein the delay and safety device contains a dual safety device of two independent parts, characterized in that the delay and safety device comprises two pyrotechnic ignition delay devices with different delay times, the two pyrotechnic ignition delay devices comprising a safety element and a delay element, wherein the delay time of the safety element is shorter than the delay time of the delay element, and the safety element includes a timing composition which, once it has burned through, ignites a gas charge, the gas of which opens at least one blocking element, and the delay element includes a firing charge, and the firing charge is only in operative connection with the detonator after the opening of the at least one blocking element, wherein the timing composition and a gas charge of the safety element are arranged in safety element chamber, and the timing composition and the firing charge of the delay element are arranged in a delay element chamber.

2. The detonator system according to claim 1, wherein the ignition element is a primer which can be initiated by a firing pin.

3. A detonator system for hand grenades, having an ignition element which after initiation triggers a delay and safety device which, with a delay after the initiation, fires a detonator, which subsequently fires an ignition booster, wherein the delay and safety device contains a dual safety device of two independent parts, characterized in that the delay and safety device comprises two pyrotechnic ignition delay devices with different delay times, the two pyrotechnic ignition delay devices comprising a safety element and a delay element wherein the delay time of the safety element is shorter than the delay time of the delay element, and the safety element includes a timing composition which, once it has burned through, ignites a gas charge, the gas of which opens at least one blocking element, and the delay element includes a firing charge, and the firing charge is only in operative connection with the detonator after the opening of the at least one blocking element, wherein the ignition element is arranged such that a fire cone of the ignition element leads into a cavity, and the cavity is connected with a safety element chamber containing the safety element and a delay element chamber containing the delay element, wherein a cone is arranged in the cavity in front of the two chambers and directs the fire cone into the safety element chamber and the delay element chamber and to the two pyrotechnic ignition delay devices.

4. The detonator system according to claim 1, wherein lower ends of the safety element and of the delay element are each equipped with a throttle cup consisting of a cone with individual, evenly distributed bore holes, or the lower ends are equipped with a threaded screw.

5. The detonator system according to claim 1, wherein the at least one blocking element is a bursting disk with predetermined breaking points on one side, or the at least one blocking element is a two-part flap valve made of metal, consisting of two superimposed disks.

6. A detonator system for hand grenades, having an ignition element which after initiation triggers a delay and safety device which, with a delay after the initiation, fires a detonator, which subsequently fires an ignition booster, wherein the delay and safety device contains a dual safety device of two independent parts, characterized in that the delay and safety device comprises two pyrotechnic ignition delay devices with different delay times, the two pyrotechnic ignition delay devices comprising a safety element and a delay element, wherein the delay time of the safety element is shorter than the delay time of the delay element, and the safety element includes a timing composition which, once it has burned through, ignites a gas charge, the gas of which opens at least one blocking element, and the delay element includes a firing charge, and the firing charge is only in operative connection with the detonator after the opening of the at least one blocking element, wherein the detonator can slide in a detonator housing from a safety position into a firing position, and is locked in both the safety and firing positions, wherein the gas generated by the gas charge slides the detonator out of the safety position and into the firing position.

7. The detonator system according to claim 6, wherein one bead or a plurality of beads is/are arranged on an outer circumference of the detonator, and latch(es) into corresponding recesses in the housing.

8. The detonator system according to claim 1, wherein the detonator can slide in a detonator housing from a safety position into a firing position, and a sliding piston is inserted into a bore hole, able to slide from a safety position into a firing position, wherein the piston supports the detonator via an elbow, and when the piston slides into its firing position, the detonator is likewise pushed into its firing position.

9. The detonator system according to claim 1, wherein a spring, a safety shutter, and a safety pin are arranged in a cavity, wherein the spring is supported on one side on a cone of the cavity and on another side on the safety shutter, and the safety shutter is supported on the safety pin, and when the safety pin is pulled, the spring slides the safety shutter toward the ignition element, thereby enabling ignition of the ignition delay device.

10. The detonator system according to claim 1, wherein the ignition element is arranged in a cup which is only fixed via a lacquer in a capsule holder, such that if the ignition element is unintentionally ignited, a jacket blowout occurs which prevents ignition of the ignition delay devices.

11. The detonator system according to claim 1, wherein the safety element chamber and the delay element chamber open into a working chamber to which the detonator is connected.

12. The detonator system according to claim 11, wherein the at least one blocking element comprises a first blocking element between the working chamber and the delay element chamber, and a second blocking element between the working chamber and the detonator.

13. The detonator system according to claim 12, wherein each of the first and second blocking elements has a valve-like structure.

14. The detonator system according to claim 12, wherein each of the first and second blocking elements comprises a one-way valve, a flap valve, or a bursting disk.

15. The detonator system according to claim 1, wherein the gas of the gas charge can open the at least one blocking element, but the firing charge and/or pressure thereof cannot open the at least one blocking element.

16. The detonator system according to claim 1, wherein the detonator can slide in a detonator housing from a safety position into a firing position.

* * * * *